US010458059B2

(12) United States Patent
Christensen

(10) Patent No.: US 10,458,059 B2
(45) Date of Patent: Oct. 29, 2019

(54) BASEMENT ASSEMBLY FOR REDUCING NOISE LEVELS OF A HOUSEHOLD APPLIANCE

(71) Applicant: WHIRLPOOL CORPORATION, Benton Harbor, MI (US)

(72) Inventor: Mark Christensen, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 79 days.

(21) Appl. No.: 15/696,655

(22) Filed: Sep. 6, 2017

(65) Prior Publication Data

US 2019/0071817 A1 Mar. 7, 2019

(51) Int. Cl.

| | |
|---|---|
| ***G10K 11/162*** | (2006.01) |
| ***G10K 11/16*** | (2006.01) |
| ***D06F 58/20*** | (2006.01) |
| ***G10K 11/00*** | (2006.01) |
| ***E04B 1/82*** | (2006.01) |
| ***D06F 39/12*** | (2006.01) |
| ***A47L 15/42*** | (2006.01) |
| *D06F 39/00* | (2006.01) |
| *G10K 11/168* | (2006.01) |

(52) U.S. Cl.

CPC ..... *D06F 58/20* (2013.01); *A47L 15/4209* (2016.11); *D06F 39/12* (2013.01); *G10K 11/162* (2013.01); *A47L 15/4272* (2013.01); *D06F 39/001* (2013.01); *G10K 11/168* (2013.01)

(58) Field of Classification Search

CPC .. A47L 15/4209; A47L 15/4251; D06F 39/12; D06F 39/001; D06F 58/20; G01K 11/168; G01K 11/162

USPC ..... 134/115 R, 200, 201; 68/3 R, 212; 181/200, 284, 295, 198

See application file for complete search history.

(56) References Cited

U.S. PATENT DOCUMENTS

| | | | | |
|---|---|---|---|---|
| 3,529,881 | A | 9/1970 | Kaldenberg | |
| 5,056,341 | A * | 10/1991 | Mori | D06F 39/001 206/320 |
| 5,515,702 | A * | 5/1996 | Park | D06F 39/12 134/201 |
| 5,855,353 | A | 1/1999 | Shaffer et al. | |
| 7,409,959 | B2 * | 8/2008 | Retsema | A47L 15/4209 134/200 |
| 8,015,848 | B2 * | 9/2011 | Colon | A47L 15/4257 68/3 R |
| 8,020,662 | B1 * | 9/2011 | Colon | A47L 15/4209 134/115 R |
| 8,556,025 | B2 | 10/2013 | Fritz et al. | |
| 8,662,246 | B2 | 3/2014 | Classen et al. | |

(Continued)

FOREIGN PATENT DOCUMENTS

| | | |
|---|---|---|
| GB | 2232422 | 12/1990 |

*Primary Examiner* — Tan Le

(74) *Attorney, Agent, or Firm* — Price Heneveld LLP

(57) ABSTRACT

A basement assembly of a household appliance is provided herein. A basement has a bottom compartment and a top compartment. The bottom compartment is separated from the top compartment and includes a plurality of voids. A plurality of acoustic pads are configured to reduce noise levels produced by the household appliance. Each of the acoustic pads is configured to be received in one of the voids. A cover member is coupled to the basement and is configured to confine the acoustic pads therein.

20 Claims, 7 Drawing Sheets

(56) References Cited

U.S. PATENT DOCUMENTS

| | | | | |
|---|---|---|---|---|
| 9,453,296 | B2 * | 9/2016 | Rockwell | D06F 37/24 |
| 2008/0128005 | A1 * | 6/2008 | Haeberle | A47L 15/4209 134/115 R |
| 2011/0232701 | A1 | 9/2011 | Colon et al. | |
| 2012/0298154 | A1 | 11/2012 | Rockwell et al. | |

* cited by examiner

BASEMENT ASSEMBLY FOR REDUCING NOISE LEVELS OF A HOUSEHOLD APPLIANCE

FIELD OF THE DISCLOSURE

The present disclosure generally relates to basement assemblies for household appliances, and more particularly, to basement assemblies that reduce noise levels produced by household appliances.

BACKGROUND OF THE DISCLOSURE

Dryers and other household appliances can produce high noise levels during operation. Accordingly, there is a need for a means of reducing the noise levels produced by such household appliances. The present disclosure is intended to satisfy this need.

SUMMARY OF THE DISCLOSURE

According to one aspect of the present disclosure, a basement assembly of a household appliance is provided. A basement has a bottom compartment and a top compartment. The bottom compartment is separated from the top compartment and includes a plurality of voids. A plurality of acoustic pads are configured to reduce noise levels produced by the household appliance. Each of the acoustic pads is configured to be received in one of the voids. A cover member is coupled to the basement and is configured to confine the acoustic pads inside the bottom compartment.

According to another aspect of the present disclosure, a basement assembly of a household appliance is provided. A basement has a bottom compartment, a top compartment, and a divider separating the bottom compartment from the top compartment. The bottom compartment includes a plurality of voids each defined by at least one of the divider and one or more side walls of the basement. At least one acoustic pad is configured to reduce noise levels produced by the household appliance. The at least one acoustic pad is configured to be received in an empty space of the bottom compartment and is frictionally engaged to at least one of the divider and the one or more side walls of the basement. A cover member is coupled to the basement and is configured to confine the at least one acoustic pad inside the bottom compartment.

According to yet another aspect of the present disclosure, a basement assembly of a household appliance is provided. A basement has a bottom compartment and a top compartment. The bottom compartment is separated from the top compartment and includes a plurality of voids. A plurality of acoustic pads are configured to reduce noise levels produced by the household appliance. Each of the acoustic pads is configured to be received in one of the voids. At least one bracket is coupled to the basement. A cover member has an outer edge portion directly engaged to the at least one bracket and another outer edge portion directly engaged to the basement to confine the acoustic pads inside the bottom compartment.

These and other aspects, objects, and features of the present disclosure will be understood and appreciated by those skilled in the art upon studying the following specification, claims, and appended drawings.

DETAILED DESCRIPTION OF THE PREFERRED EMBODIMENTS

As required, detailed embodiments of the present disclosure are provided herein. However, it is to be understood that the disclosed embodiments are merely exemplary and may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present disclosure.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Figure 1:
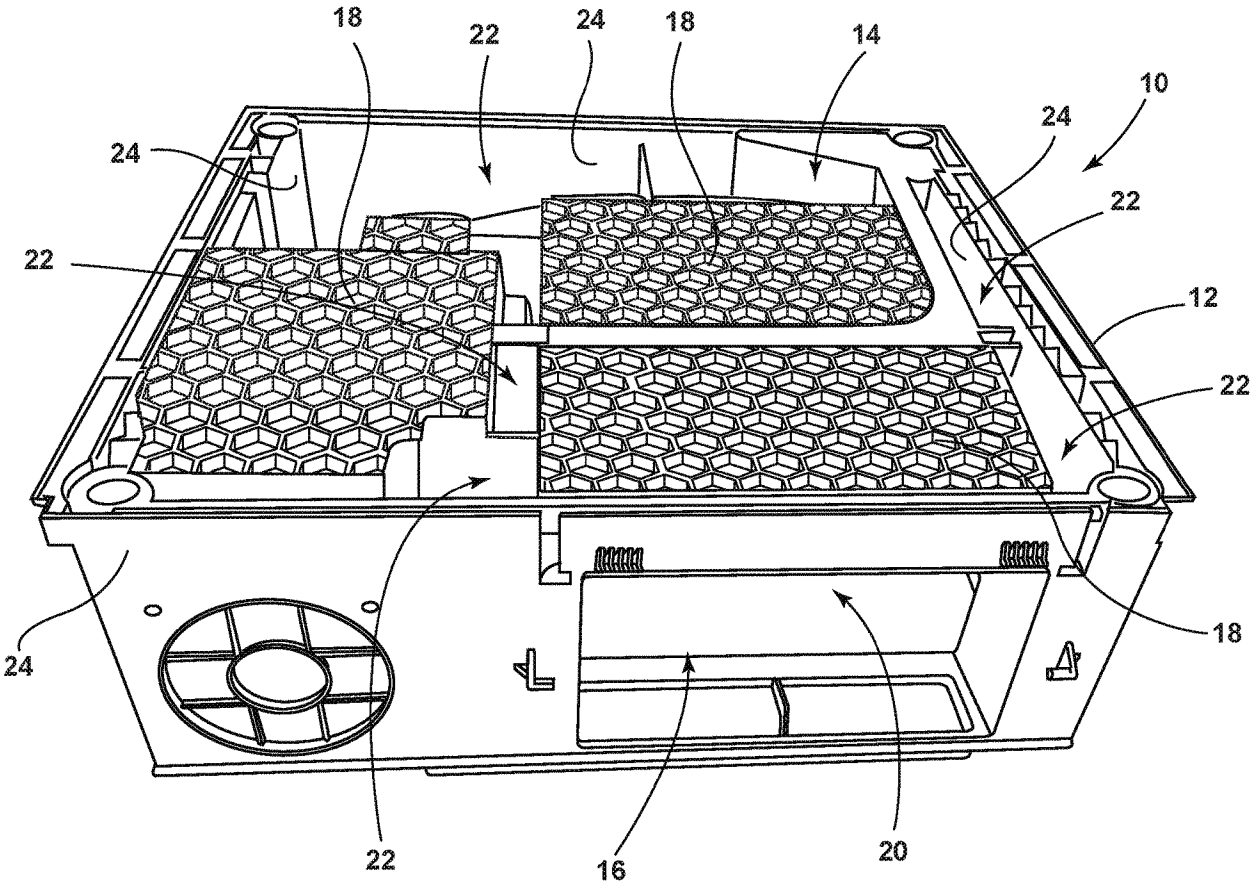
FIG. 1 is a perspective view of a basement assembly having a bottom compartment separated from a top compartment.

Referring to FIG. 1, a basement assembly 10 is shown according to one embodiment. The basement assembly 10 generally forms the base of a household appliance such as, but not limited to, a dryer. As depicted, the basement assembly 10 includes a basement 12 that is square-shaped and is constructed from a rigid material such as, for example, plastic. The basement 12 may be formed as a single piece having a bottom compartment 14 separated from a top compartment 16 by a divider 18. For purposes of illustration, the basement 12 is depicted in an inverted position such that the bottom compartment 14 is positioned above the top compartment 16. However, it is to be understood that when the basement 12 is installed to the household appliance, the bottom compartment 14 typically occupies a lower position relative to the top compartment 16 within the household appliance.

With continued reference to FIG. 1, the divider 18 spans the basement 12 from side-to-side and partitions the top compartment 16 into one or more sub-compartments 20. Sub-compartments 20 may be variably sized and dimensioned to accommodate particular components of the household appliance. For example, in dryer embodiments, the sub-compartments may accommodate a motor, a blower, air ducts, heating elements, drum support structures, and/or any other dryer components known to a skilled artisan. Accordingly, it is to be understood that the divider 18 may be configured to extend in a variety of directions at different angles and/or curvature.

Additionally, the divider 18 defines a plurality of voids 22 in the bottom compartment 14. The voids 22 typically correspond to the space around the sub-compartments of the top compartment 16. More specifically, the plurality of voids 22 may include the space between neighboring sub-compartments, the space between a sub-compartment and a sidewall 24 of the basement 12, and/or the space beneath one or more sub-compartments 20. Collectively, the voids 22 define the empty space of the bottom compartment 14.

Figure 2:
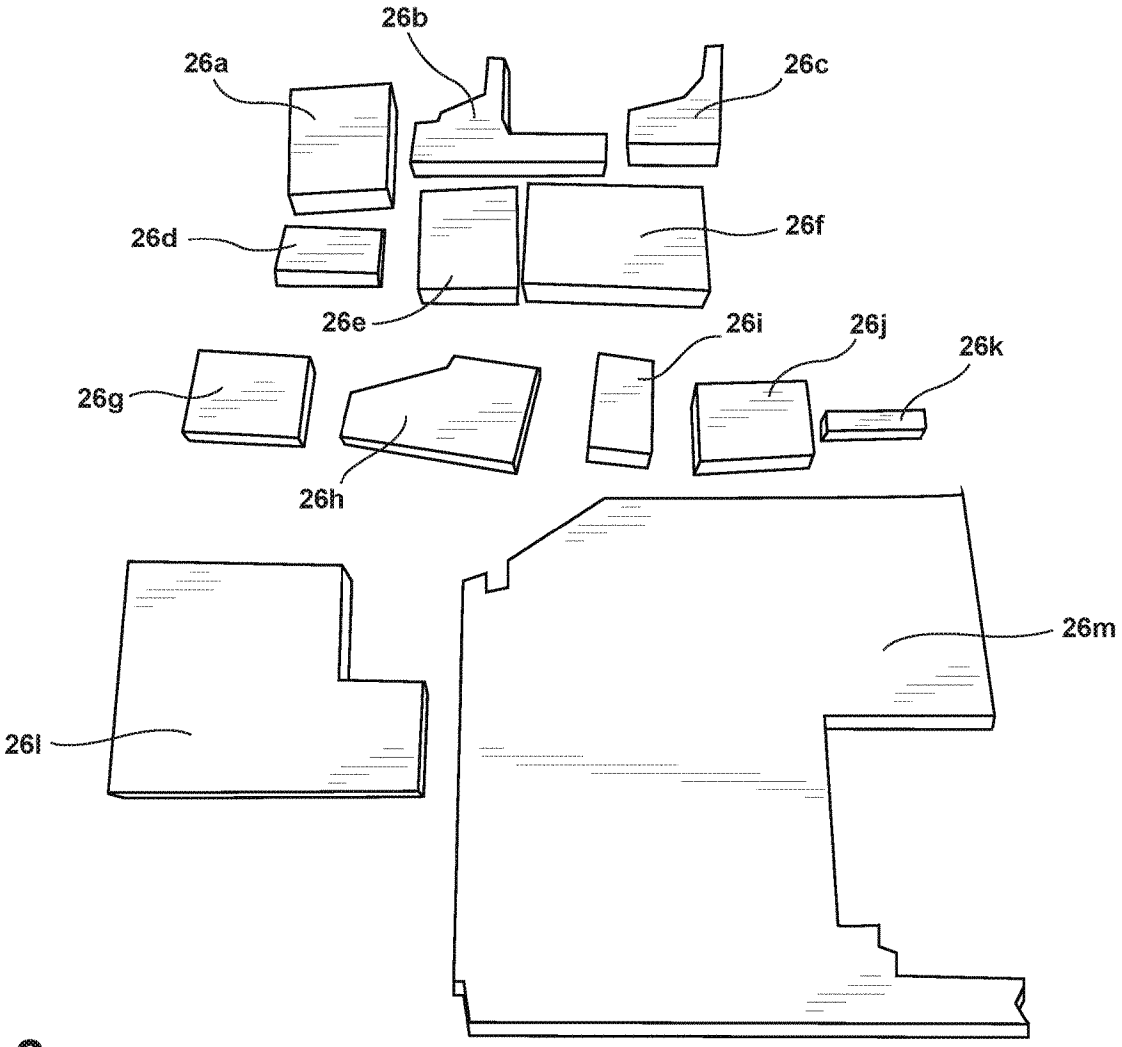
FIG. 2 illustrates a plurality of acoustic pads configured to be received in an empty space of the bottom compartment.

Referring to FIG. 2, a plurality of acoustic pads 26*a*-26*m* are exemplarily shown. The acoustic pads 26*a*-26*m* are each configured to be received in a corresponding void 22 of the bottom compartment 14. The acoustic pads 26*a*-26*m* include a foam-based material or a fiber-based material and may vary in size and dimension. Each acoustic pad 26*a*-26*m* may be configured as a regular or irregular geometric shape based on the respective shape of the corresponding void 22. Accordingly, it is to be understood that at least a number of the acoustic pads 26*a*-26*m* may be form-fitted to the corresponding void(s) 22. In assembly, the acoustic pads 26*a*-26*m* are inserted in the corresponding voids 22 of the bottom compartment 14 at various depths so as to fill a substantial portion of the empty space of the bottom compartment 14 and serve to reduce noise levels produced by the household appliance.

Figure 3:
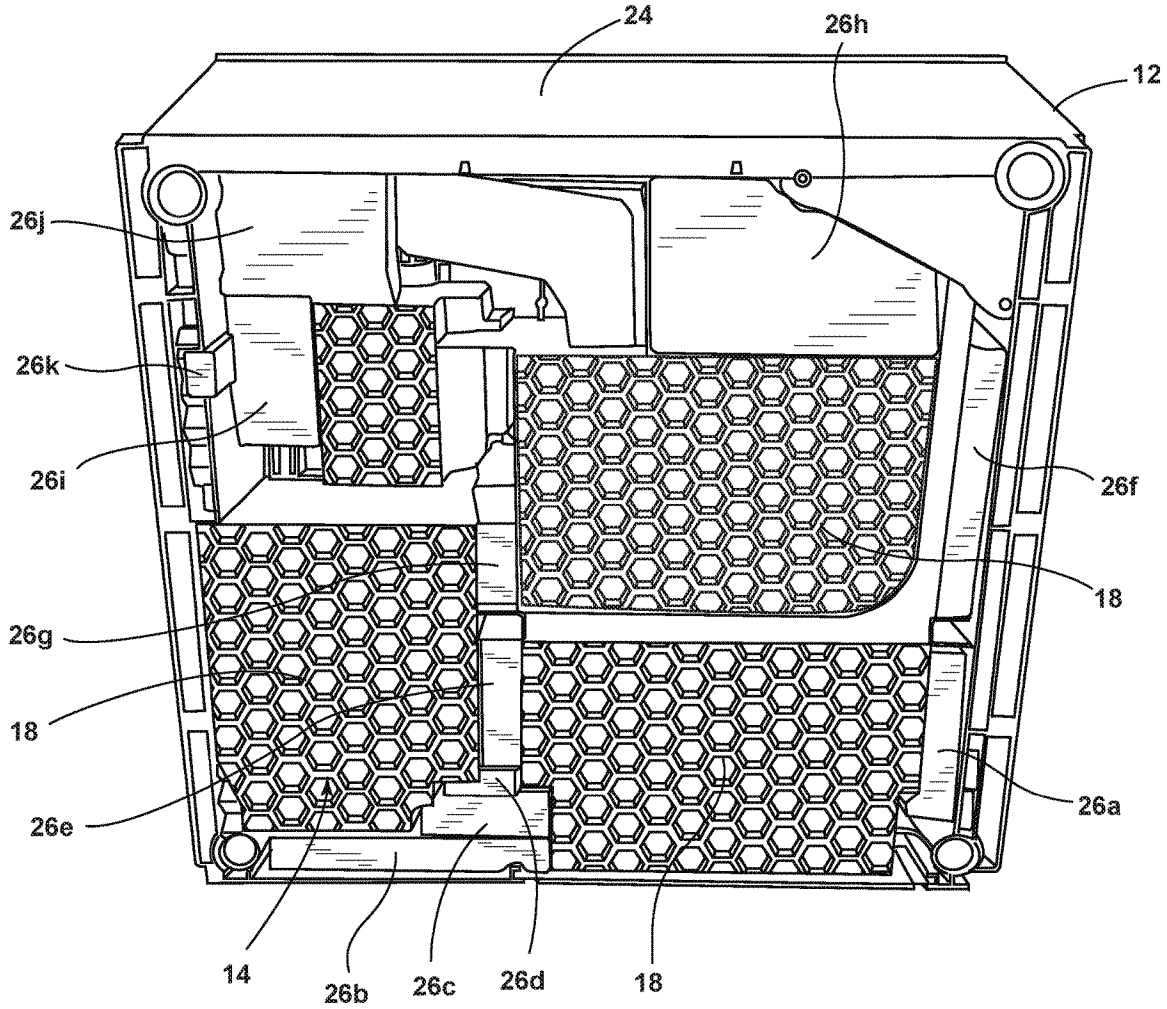
FIGS. 3-5 illustrate the assembly of the acoustic pads to the bottom compartment.
Figure 4:
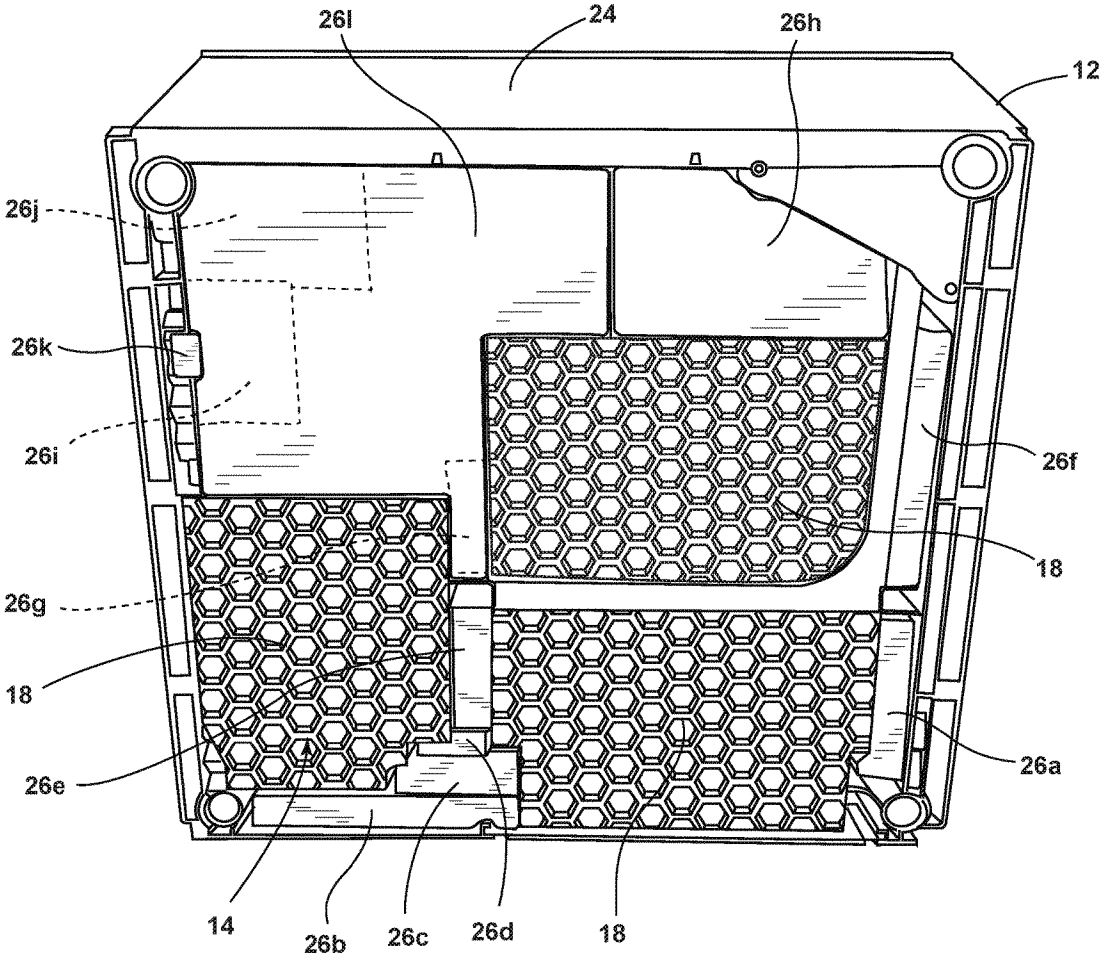
Figure 5:
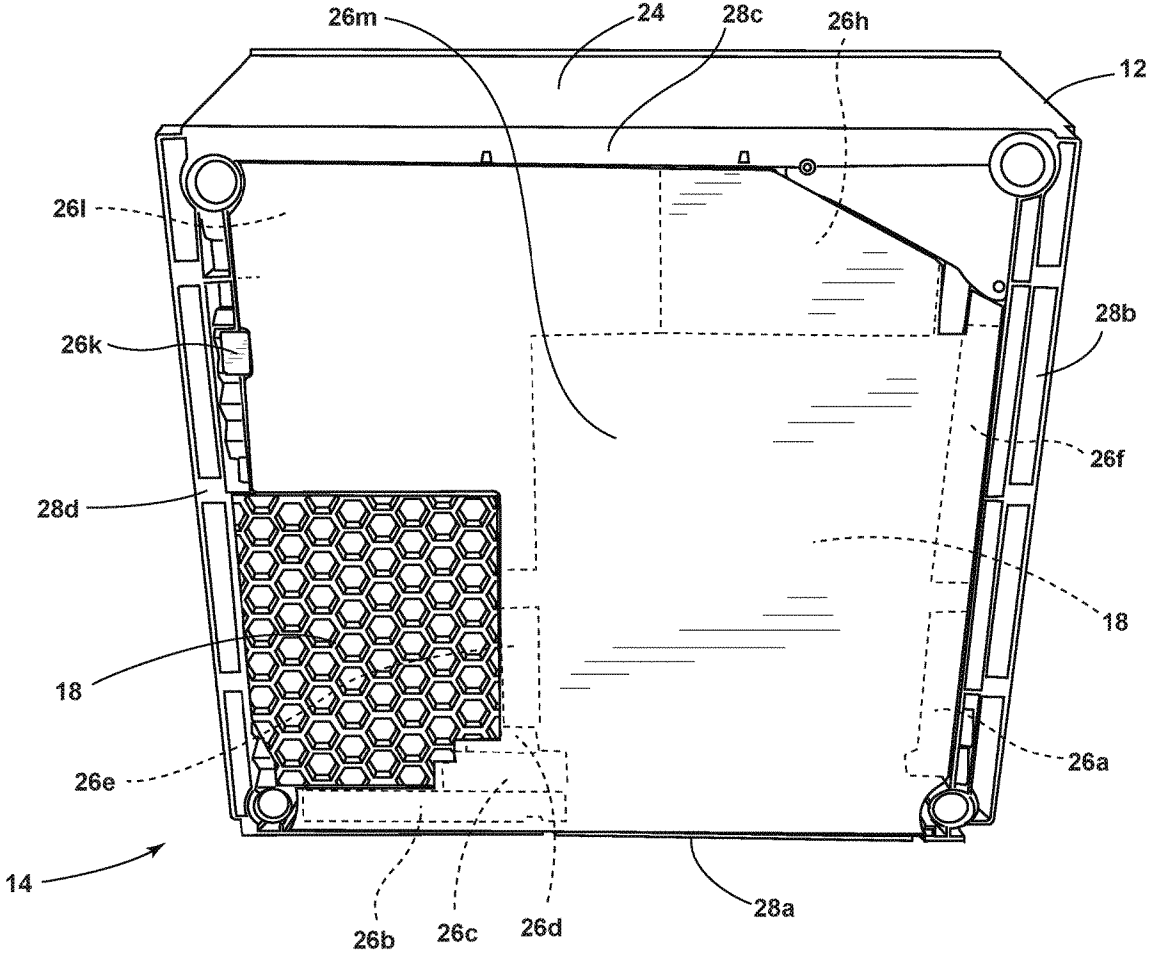

Referring to FIGS. 3-5, the acoustic pads 26*a*-26*m* are shown assembled to the bottom compartment 14. With respect to the depicted embodiment, one or more of the acoustic pads 26*a*-26*m* are received in each void 22 and are held in place through frictional engagement with the divider 18 and/or one or more sidewalls 24 of the basement 12. In assembly, and with specific reference to FIG. 3, acoustic pads 26*a*-26*k* are first to be received in corresponding voids 22. In the depicted embodiment, acoustic pads 26*b*-26*d* and 26*i*-26*k* sharing the same void 22 may be arranged side-by-side to effectively fill the space thereof. Next, and with specific reference to FIG. 4, acoustic pad 261 is stacked on top of acoustic pads 26*g*, 26*i*, and 26*j* to help fill the space of the corresponding voids 22 associated therewith. Lastly, and with specific reference to FIG. 5, acoustic pad 26*m* is stacked on top of acoustic pads 26*a*-261 to fill the remaining space of the bottom compartment 14. In the depicted embodiment, acoustic pad 26*m* is flush with bottom perimeter edges 28*a*-28*d* of the basement 12 and may also be flush with portions of the divider 18. In such an arrangement, a substantial majority of the empty space of the bottom compartment 14 can be filled.

In alternative embodiments, a lesser number of acoustic pads may be utilized to accomplish the same. For example, it is contemplated that acoustic pads 26*b*-26*d* and 26*i*-26*k* may be combined as a unitary piece. Thus, it will be appreciated that a portion or all of the acoustic pads 26*a*-26*m* may benefit from a one-piece design. Furthermore, while some space of the bottom compartment 14 is shown unfilled, it is to be understood that additional acoustic pads may be constructed to be received therein. As such, depending on the desired ease of construction, some or substantially all of the empty space of the bottom compartment 14 can be filled.

Figure 6:
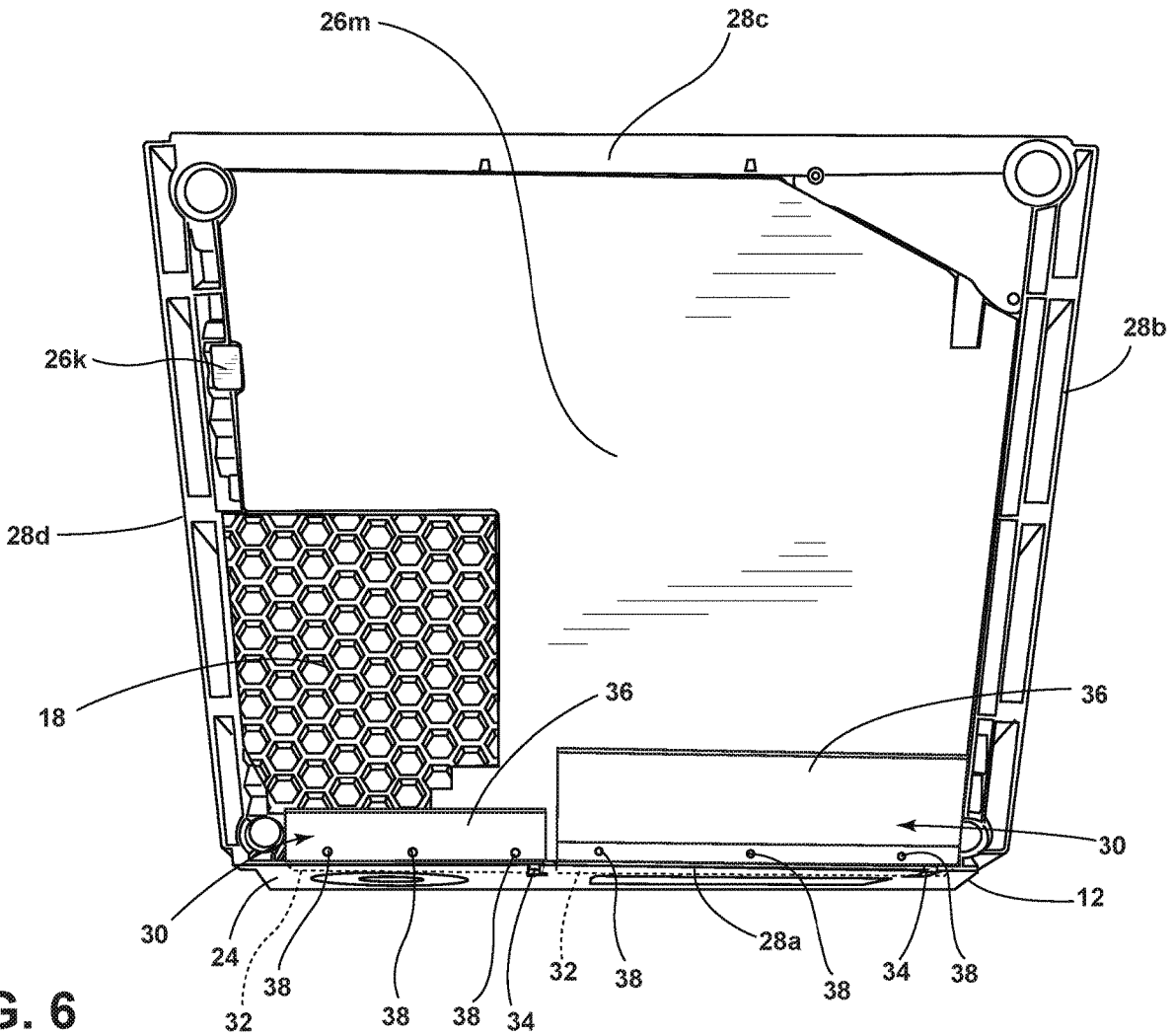
FIG. 6 illustrates the assembly of one or more brackets to the basement.

Referring to FIG. 6, the basement assembly 10 also includes one or more brackets 30 coupled to the basement 12. Each bracket 30 is L-shaped and includes a first extent 32 of variable length and width and configured to be received in a corresponding slot 34 formed in the basement 12 proximate one of the bottom perimeter edges 28*a* of the basement 12. Each bracket 30 also includes a second extent 36 projecting inward within the bottom compartment 14. The second extent 36 of each bracket 30 may have variable length and width and may be in abutting contact with one or more acoustic pads (e.g., acoustic pad 26*m*). The second extent 36 of each bracket 30 includes one or more screw holes 38 running lengthwise thereon. The screw holes 38 may be evenly spaced and are generally aligned with one another in a common longitudinal direction.

Figure 7:
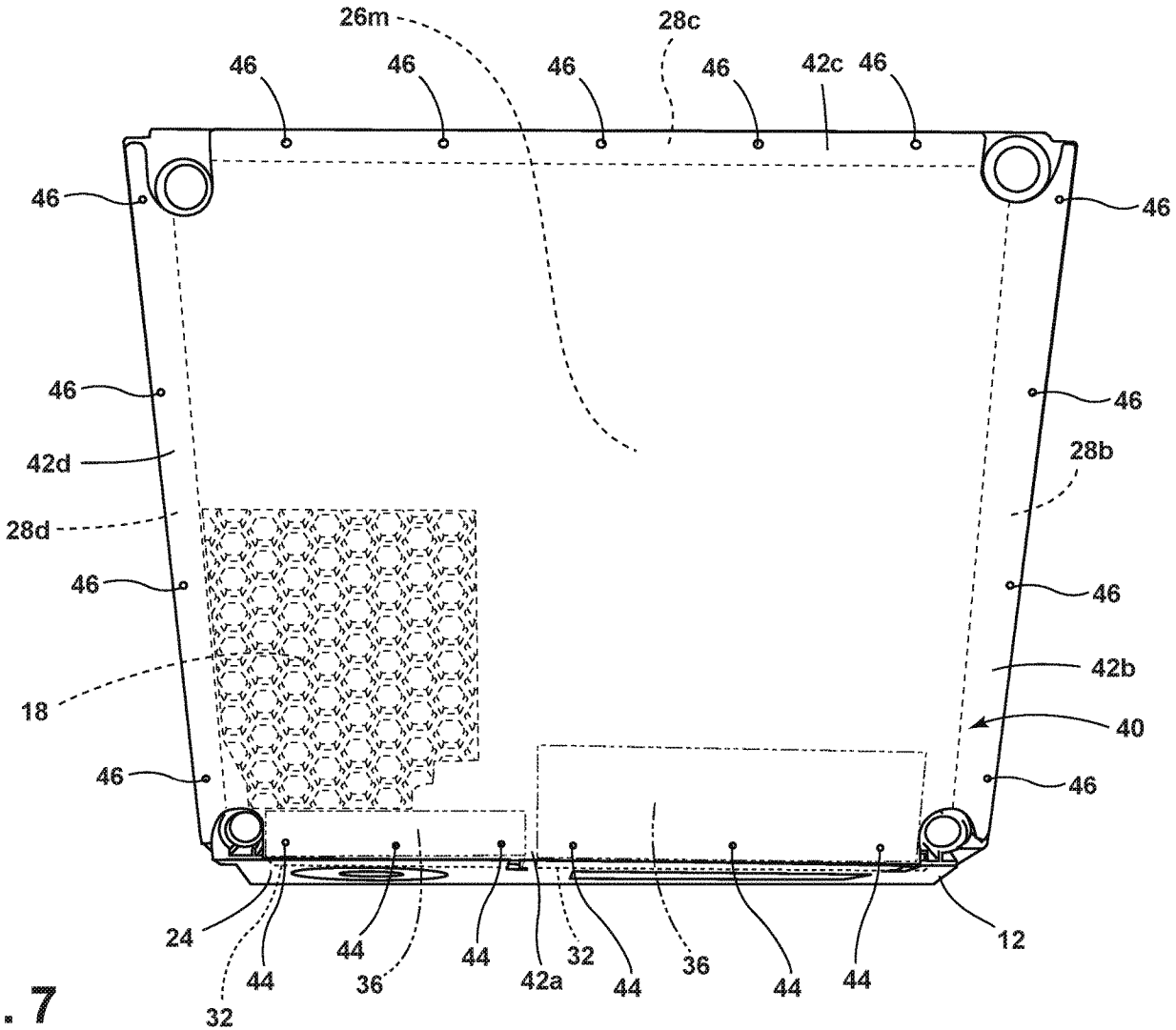
FIG. 7 illustrates the assembly of a cover member to the basement to confine the acoustic pads inside the bottom compartment.

Referring to FIG. 7, the basement assembly 10 further includes a cover member 40 coupled to the basement 12 and configured to confine the acoustic pads 26*a*-26*m* inside the bottom compartment 14. The cover member 40 is square-shaped to complement the basement 12 and includes outer edge portions 42*a*-42*d*. One or more screw holes 44 are formed through the cover member 40 proximate one of the outer edge portions 42*a* and complementing the screw holes 38 of each bracket 30. In assembly, the cover member 40 is positioned atop the bottom compartment 14 such that the screw holes 44 of the cover member 40 are aligned with the screw holes 38 of each bracket 30. Once aligned, outer edge portion 42*a* of the cover member 40 is directly secured to each bracket 30 via screws (not shown) engaged to screw holes 44 and 38, respectively. The remaining outer edge portions 42*b*-42*d* of the cover member 40 are then directly engaged to corresponding bottom perimeter edges 28*b*-28*d* of the basement 12 via mechanical fasteners or any other suitable fastening means. For example, outer edge portions 42*b*-42*d* may include screw holes 46 aligned with complementary screw holes (not shown) formed in corresponding perimeter edges 28*b*-28*d* for receiving screws (not shown) therein for directly engaging the cover member 40 to the basement 12. It is contemplated that the cover member 40 may be configured as a metal (e.g., steel) sheet and may abut one or more acoustic pads (e.g., acoustic pad 26*m*) along with portions of the divider 18. Upon assembly of the cover member 40 to the basement 12, the basement assembly 10 is readily installed to the household appliance.

Modifications of the disclosure will occur to those skilled in the art and to those who make or use the disclosure. Therefore, it is understood that the embodiments shown in the drawings and described above are merely for illustrative purposes and not intended to limit the scope of the disclosure, which is defined by the following claims as interpreted according to the principles of patent law, including the doctrine of equivalents.

It will be understood by one having ordinary skill in the art that construction of the described disclosure, and other components, is not limited to any specific material. Other exemplary embodiments of the disclosure disclosed herein may be formed from a wide variety of materials, unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature, or may be removable or releasable in nature, unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the basement assembly may be varied, and the nature or numeral of adjustment positions provided between the elements may be varied. It should be noted that the elements and/or assemblies of the basement assembly may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes, or steps within described processes, may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further, it is to be understood that such concepts are intended to be covered by the following claims, unless these claims, by their language, expressly state otherwise. Further, the claims, as set forth below, are incorporated into and constitute part of this Detailed Description.

What is claimed is:

1. A basement assembly of a household appliance, comprising:

a basement having a bottom compartment and a top compartment, the bottom compartment separated from the top compartment and comprising a plurality of voids;

a divider positioned within the basement and at least partially separating the bottom compartment from the top compartment, wherein the plurality of voids are defined within the divider;

a plurality of acoustic pads configured to reduce noise levels produced by the household appliance, each acoustic pad of the plurality of acoustic pads disposed within one void of the plurality of voids, respectively, wherein a portion of the plurality of acoustic pads extends through the divider; and a cover member coupled to the basement and configured to confine the acoustic pads inside the bottom compartment and the voids.

2. The basement assembly of claim 1, wherein the acoustic pads each comprise one of a foam-based material and a fiber-based material, and are each configured as one of a regular geometric shape and an irregular geometric shape.

3. The basement assembly of claim 1, wherein a portion of the acoustic pads are arranged side-by-side to fill a space of a corresponding void.

4. The basement assembly of claim 1, wherein a portion of the acoustic pads are stacked on one another to fill a space of a corresponding void.

5. The basement assembly of claim 1, wherein the top compartment is partitioned into one or more sub-compartments.

6. The basement assembly of claim 5, wherein each void comprises at least one of a space between neighboring sub-compartments, a space between a sub-compartment and a sidewall of the basement, and a space beneath one or more sub-compartments.

7. The basement assembly of claim 1, wherein at least a portion of the cover member is directly engaged to the basement and the cover member abuts at least one of the acoustic pads.

8. A basement assembly of a household appliance, comprising:

a basement having a bottom compartment, a top compartment, and a divider separating the bottom compartment from the top compartment, the bottom compartment comprising a plurality of voids each defined by at least one of the divider and one or more side walls of the basement, wherein a void of the plurality of voids is defined within the divider to define a plurality of sub-compartments within the top compartment of the basement;

at least one acoustic pad configured to reduce noise levels produced by the household appliance, the at least one acoustic pad disposed within an empty space of the bottom compartment and frictionally engaged to at least one of the divider and the one or more side walls of the basement, wherein an acoustic pad of the at least one acoustic pad is positioned within the void to extend between and at least partially separate adjacent sub-compartments of the plurality of sub-compartments; and a cover member coupled to the basement and configured to confine the at least one acoustic pad inside the bottom compartment.

9. The basement assembly of claim 8, wherein the at least one acoustic pad comprises one of a foam-based material and a fiber-based material.

10. The basement assembly of claim 8, wherein the at least one acoustic pad fills a substantial majority of the empty space of the bottom compartment.

11. The basement assembly of claim 8, wherein the at least one acoustic pad is flush with at least one of a bottom perimeter edge of the basement and a portion of the divider.

12. The basement assembly of claim 8, wherein the divider is integrated with the basement and spans the basement side-to-side.

13. The basement assembly of claim 8, wherein at least a portion of the cover member is directly engaged to the basement and the cover member abuts at least one of the acoustic pads.

14. A basement assembly of a household appliance, comprising:

a basement having a bottom compartment and a top compartment, the bottom compartment separated from the top compartment and comprising a plurality of voids;

a plurality of acoustic pads configured to reduce noise levels produced by the household appliance, each of the acoustic pads is received in one of the voids, wherein a portion of the acoustic pads of the plurality of acoustic pads extends through a divider that partially separates the bottom compartment from the top compartment;

at least one bracket coupled to the basement; and a cover member having an outer edge portion directly engaged to the at least one bracket and another outer edge portion directly engaged to the basement to confine the acoustic pads inside the bottom compartment.

15. The basement assembly of claim 14, wherein the acoustic pads each comprise one of a foam-based material and a fiber-based material and are received in the voids at varying depths.

16. The basement assembly of claim 14, wherein the cover member comprises a metal sheet directly engaged to the at least one bracket and the basement via mechanical fasteners.

17. The basement assembly of claim 14, wherein the at least one bracket comprises a first extent disposed between at least one of the acoustic pads and a sidewall of the basement, and a second extent projecting inward within the bottom compartment and abutting at least one of the acoustic pads.

18. The basement assembly of claim 17, wherein the at least one bracket is L-shaped.

19. The basement assembly of claim 17, wherein the first extent is received in a slot formed in the basement.

20. The basement assembly of claim 17, wherein the voids collectively define an empty space of the bottom compartment and the acoustic pads fill a substantial portion of the empty space.

* * * * *